United States Patent [19]

Shen et al.

[11] 4,280,860

[45] Jul. 28, 1981

[54] PROCESS FOR MANUFACTURING NONWOVEN FABRICS COMPOSED OF CRIMPED FILAMENTS

[75] Inventors: Hsiang-Sheng Shen; LeMoyne W. Plischke; William M. Baggett, all of Pensacola; Franklin T. Osborne, Gulf Breeze, all of Fla.

[73] Assignee: Monsanto Company, St. Louis, Mo.

[21] Appl. No.: 90,825

[22] Filed: Nov. 2, 1979

[51] Int. Cl.[3] ..... D04H 5/14; D01D 5/22; D02G 1/18

[52] U.S. Cl. ..... 156/167; 156/181; 264/168; 264/171; 264/211; 428/370; 428/373

[58] Field of Search ..... 156/167, 181, 290; 428/370, 369, 374, 198, 362, 373; 264/168, 171, 211, 174, 176 F, 248

[56] References Cited

U.S. PATENT DOCUMENTS

| | | | |
|---|---|---|---|
| 3,341,394 | 9/1967 | Kinney | 428/369 |
| 3,509,013 | 4/1970 | Oppenlander | 428/373 |
| 3,582,418 | 6/1971 | Schuur | 428/373 |
| 3,589,956 | 6/1971 | Kranz et al. | 428/369 |
| 3,798,296 | 3/1974 | Kellet | 264/168 |

FOREIGN PATENT DOCUMENTS

| | | | |
|---|---|---|---|
| 45-1935 | 1/1970 | Japan | 428/370 |

*Primary Examiner*—Michael W. Ball
*Attorney, Agent, or Firm*—John W. Whisler

[57] ABSTRACT

An improved process for making point-bonded nonwoven fabric composed of crimped filaments is described. The process involves melt spinning a side-by-side bicomponent filament which develops crimp at precisely the right instant so as to provide a uniform, high quality nonwoven fabric having a soft hand and other desirable apparel qualities.

6 Claims, No Drawings

PROCESS FOR MANUFACTURING NONWOVEN FABRICS COMPOSED OF CRIMPED FILAMENTS

BACKGROUND OF THE INVENTION

1. Field of the Invention

This invention relates to an improvement in the spunbonded process for making nonwoven fabrics whereby uniform fabrics composed of crimped filaments are obtained. Fabrics made in accordance with the present invention have apparel-like qualities (i.e. soft hand, flexibility, washability, etc.).

2. Description of the Prior Art

It is well known in the art that nonwoven fabrics can be produced by a continuous process from a melt (hereinafter referred to as "Spun Point-Bonded Process" or simply as "SPB Process") comprising the steps of melt spinning continuous filaments from a fiber-forming polymer melt such as nylon or polyester, pneumatically attenuating the filaments, depositing the filaments onto a moving surface such as a moving foraminous belt, usually in a random pattern, to form a uniform web of unbonded filaments, advancing the web, point-bonding the filaments to provide a nonwoven fabric and, finally, collecting the resulting fabric. The term "point-bonding" as used herein means the process of bonding the filaments of the web at a substantial number of spaced points (points where filaments cross-over) so that a discrete pattern of spaced filament bonds is formed. The bonding may be effected by either chemical or mechanical means. Attenuation of the filaments and deposition thereof onto the moving surface are conventionally accomplished by passing the freshly extruded filaments through a pneumatically operated aspirator. The aspirator serves not only to withdraw the filaments from the spinneret at a rate sufficient to impart a jet stretch thereto but also to advance the filaments to the moving belt. In passing through the aspirator the filaments assume a bundle configuration. The highest quality fabrics are obtained when the filaments are separated from one another at the time they are deposited onto the moving surface. Accordingly, if desired or necessary, the filaments after leaving the aspirator and before reaching the belt may be spread apart (or separated) by conventional means, such as by applying an electrical charge thereto in the manner described in U.S. Pat. No. 3,967,118. Typically, the velocity of the filaments leaving the aspirator are in the range of from 3000 to 5000 yds/min (2743.2–4572 m/min.) and the equipment is arranged such that the period of time lapsing from the time the filaments leave the spinneret until they are deposited on the belt is considerably less than 0.5 second and is usually in the range of from 0.02 to 0.05 second.

While it would be expected that nonwoven fabrics composed of crimped filaments would have a softer hand and superior flexibility, drape, washability and generally better apparel-like qualities than corresponding fabrics composed of uncrimped filaments, a satisfactory technique for crimping filaments during the SPB Process has not heretofore been developed. Unless the crimp is developed in the filaments after they leave the aspirator and before they are deposited on the moving surface, the quality and uniformity of the resulting fabric are greatly reduced. If the crimp is developed while the filaments are in a bundle configuration (i.e. before they leave the aspirator), filament entanglement occurs causing rope-like structures to be formed, the filaments of which, cannot be separated by conventional separation means before the filaments are deposited on the moving surface. The presence of such structures greatly reduce the quality of uniformity of the resulting fabric. On the other hand, if the crimp is developed after the filaments are deposited on the moving surface, the crimping motion causes undesirable drawing-up, i.e., distortion or disruption, of the web configuration which in turn greatly reduces the quality and uniformity of the resulting fabric.

SUMMARY OF THE INVENTION

The present invention provides an improvement in the SPB Process whereby high quality, uniform nonwoven fabrics composed of crimped filaments and having apparel-like qualities are prepared. The improvement comprises extruding a side-by-side bicomponent filament in which both components are comprised of the same polymer and one of the components contains calcium fluoride ($CaF_2$) uniformly dispersed therein. Surprisingly, in the SPB Process filaments of this description develop crimp at precisely the right instant, that is, after the filaments leave the attenuator and before the filaments are deposited on the moving surface. Preferably, the filaments are of a non-round cross-sectional shape and the ratio of the cross-sectional area of the $CaF_2$ component of the filament to the cross-sectional area of the other component of the filament and the concentration of $CaF_2$ in the $CaF_2$ component are correlated to obtain filaments having a developed crimp level of at least 5 crimps inch (196.9 crimps per meter) and preferably at least 10 crimps per inch (393.7 crimps per meter). When used hereinafter, the term "ratio" unless otherwise specified has reference to the cross-sectional areas of the filament components.

Nonwoven Fabrics made using the improvement described herein have a soft hand, good drape and flexibility, good washability and, in general, good apparel-like qualities.

DESCRIPTION OF THE PREFERRED EMBODIMENTS

The SPB Process comprises the steps of melt spinning, attenuating, depositing (or laying down), and point-bonding filaments to provide a nonwoven fabric that is then collected. Optionally, after the attenuating step and before the depositing step the filaments maybe subjected to a separating step. The process and the above steps are known in the art and therefore are not described in detail therein. The improvement of the present invention relates to the melt spinning step and comprises melt spinning a side-by-side bicomponent filament wherein both components are comprised of the same polymer composition and one of the components contains $CaF_2$ uniformly dispersed therein, whereby filaments are provided which develop crimp after the attenuating step and before the depositing or laydown step. The bicomponent filaments may be produced by conventional conjugate melt spinning techniques using commercially available spinning apparatus where the components are joined in a stratified flow of melts through a spinneret assembly without intimate mixing of the components, such as described in U.S. Pat. No. 3,730,662.

Factors which influence or have an effect on the crimp level of the bicomponent filaments are the particular polymer from which the filaments are spun; the cross-sectional shape of the filaments; processing conditions, the ratio of the $CaF_2$ component to the other component; and the concentration of the $CaF_2$ in the $CaF_2$ component.

In practicing the improvement of the present invention using a given set of processing conditions and a given polymer of a given cross-sectional shape, the crimp level of the resulting filament will depend on the ratio of $CaF_2$ component to the other component and on the concentration of $CaF_2$ in the $CaF_2$ component. Preferably, the ratio of the components and the concentration of $CaF_2$ are correlated to obtain filaments having a devloped crimp level of at least 5 crimps per inch. In general, at a given concentration of $CaF_2$ in the $CaF_2$ component, the crimp level in terms of crimps per inch (cpi) increases to a maximum level and thereafter decreases as the ratio of $CaF_2$ component to the other component, is increased from 0:100 to 60:40. In the case of nylon 66, maximum crimp level is obtained when the ratio of $CaF_2$ component to the other component is about 35:65. The concentration of $CaF_2$ in the $CaF_2$ component may vary over a wide range. It has been found that a $CaF_2$ concentration of at least 500 ppm in the $CaF_2$ component is needed in order to provide filaments that develop a usable crimp at the proper time during the process, i.e., after attenuation and before laydown of the filaments. On the other hand, increasing the $CaF_2$ concentration above about 2000 ppm has been found to have no significant effect on crimp level. Therefore, in the interest of cost savings, $CaF_2$ concentrations above about 2000 ppm are not recommended. Of course, $CaF_2$ concentrations above 2000 ppm (e.g. 8,000 to 12,000 ppm or higher) may be used if desired.

Processing conditions which have an effect on the crimp level of the resulting filaments are quenching conditions and aspirator conditions. Although the use of a cross flow of air to assist in the quenching of the filaments may not be necessary in order to effectively carry out the process, the use thereof tends to increase the crimp level of the resulting filaments. Generally, a cross flow of air is used when a large number of filaments are being quenched. Also, the crimp level of the resulting filaments tends to increase as the speed at which the filaments are passed through the aspirator is increased. Also, higher crimp levels are obtained with filaments of a non-round cross-sectional configuration, for example, a trilobal cross-section. Although the improvement described herein does not require the use of the foregoing quenching conditions or filaments of a non-round cross-section, the use thereof tends to provide filaments having maximum crimp levels.

Polymers which may be used in carrying out the improvement are fiber-forming, such as polyamides and polyesters. Suitable polyamides include nylon 66 (polyhexamethylene adipamide) and nylon 6 (polycaprolactam) and copolyamides formed by the condensation of two or more diamines with one or more dicarboxylic acids or vice versa, such as, the condensation product of adipic acid, terephthalic acid and hexamethylene diamine (i.e. nylon 66/6T) and the condensation product of adipic acid, caprolactam and hexamethylene diamine (i.e. nylon 66/6). Preferred copolymers are nylon 66/6, nylon 66/6T and nylon 66/6/6T wherein at least 88 mole % of the copolymer are hexamethylene adipamide units. Polyester which may be used in carrying out the improvement include those of polymeric hydroxycarboxylic acids and lower alkylene glycols such as ethylene glocol and tetramethylene glycol. A preferred polyester is polyethylene terephthalate.

The following examples are given to further illustrate the invention.

EXAMPLE 1

This example illustrates the preparation of polymers suitable for use in practicing the improvement of the present invention.

$CaF_2$ was prepared by the addition of 685.3 grams (2.905 moles) of calcium bromide dihydrate to 546.9 grams (5.810 moles) of potassium fluoride and 14061.29 grams of water to a stainless steel vessel equipped with a mechanical stirrer. The resulting aqueous $CaF_2$ slurry was stirred without interruption until it was ready for use so as to prevent $CaF_2$ from precipitating. The total weight of the slurry was 33.7 lbs (15.3 Kg).

A stainless steel autoclave adapted for batch polymerization of nylon 66 was filled with nitrogen gas and was thereafter charged with 250 lbs (113.4 Kg) of an aqueous solution containing 48.55% by weight of hexamethylene diammonium adipate (nylon 66 salt). The contents of the autoclave were heated to a temperature of 200° C. under 250 psig ($1825.0\times10^3$ newtons/$m^2$) pressure at which time the above prepared $CaF_2$ slurry was added thereto. Heating of the contents continued until the nylon-forming materials in the autoclave reached a temperature of 243° C. At this stage bleeding off of water vapor was begun to reduce the pressure in the autoclave to atmospheric pressure. During this pressure reduction stage which lasted 40 minutes, the polymer temperature was gradually increased to 270° C. The molten polymer was then held at this temperature for twenty minutes to bring the polymer to equilibrium. At the end of the twenty-minute holding period, the polymer was extruded in the form of a ribbon onto a casting wheel where it was quenched with water. Thereafter, the ribbon was cut into chips suitable for melt spinning into filaments. The chips consisted of nylon 66 containing uniformly dispersed therein 2000 parts by weight of $CaF_2$ per million parts of nylon 66.

A second batch of chips were prepared using the above procedure except in this instance $CaF_2$ slurry was not added to the autoclave. These chips consisted of nylon 66 and did not contain $CaF_2$.

EXAMPLE 2

This example illustrates the preparation of a nonwoven fabric composed of crimped filaments using the standard SPB Process incorporating the improvement of the present invention.

Each of the polymers prepared in Example 1 was fed as a separate molten stream to each of four, 28-hole spinneret assemblies to form side-by-side bicomponent filaments. Polymer was extruded through each of the round holes at the rate of 1.3 grams per minute. 16 reciprocating aspirators through which the filaments passed were used to withdraw the filaments from the spinneret, attenuate the filaments and deposit the filaments onto a moving foraminous belt. The aspirators attenuated the filaments to a denier per filament (dpf) of 4.9 and were positioned about 40 inches (101.6 cm) below the spinnerets. There were four aspirators for each spinneret (one per seven filaments). Each aspirator was supplied with compressed air having an input pressure of 75 psig ($618.5\times10^3$ newtons/$m^2$). After leaving the aspirators the filaments were deposited on a moving, endless, foraminous belt positioned about 48 inches (121.9 cm) below the aspirators. The speed of the belt was adjusted to provide a fabric having a weight of 1.52 oz/yd$^2$ (51.58 g/m$^2$). Ambient conditions during lay down were: dry/wet bulk temperatures of 80° F./67° F. (27.6° C./19.4° C.). The unbonded web was pressed (1-2 psig, $108.2\times10^3$–$115.1\times10^3$ newton/m$^2$, cylinder pressure) by a pair of prepressing rolls while remaining on the belt.

The web was then lifted from the belt by means of being pulled over a lift bar and was then passed through a preconditioning chamber where it was exposed for 40 seconds to air having a dry bulb temperature of 80° F. (27.6° C.), a dew pooint of 71° F. (21.7° C.) and a relative humidity of 65%. From the preconditioning chamber the web was passed through a gas chamber where it was exposed for 12 seconds to gaseous HCl. The web, which had picked up 1.25 to 1.75% by weight HCl, was then passed through a post-conditioning chamber where it was exposed to air having a dry bulk temperature of 80° F. (27.6° C.) and a relative humidity of 65%. The web was then pressed between the nip of two cooperating calender rolls, one smooth and one embossed roll heated to 190° F. (87.8° C.). The resulting pattern bonded (point-bonded) web, after being passed through a water bath where HCl was removed or desorbed from the web, was dried at 150° F. (65.6° C.) and taken-up. The resulting fabric was uniform in appearance and composed of crimped filaments the filaments being crimped between bond points. The fabric was flexible and had a remarkably soft, cotton-like hand.

Samples of the filaments were taken from the belt and the crimp level thereof, expressed in terms of crimps per non-extend inch of filament length ($C_o$) was determined by dividing by 10 the number of crimps in a filament sample measuring 10 inches (25.4 cm) in length while the filament is under no tension. The crimp level, expressed in terms of crimps per extended inch of filament length ($C_E$) was then determined on the same filament of crimps previously counted for the 10 inch non-extended length of filament by the length of the filament in inches the filament is under while the filament is under sufficient tension to straighten out the crimp without stretching the filament. Several random samples were taken and averaged. $C_o$ was found to be 11.04 and $C_E$ was found to be 7.2.

EXAMPLES 3-13

Addition nonwoven fabrics were prepared using the same procedure as described in Example 2 except that processing conditions were varied from example to example in the manner indicated in Table I below. Examples 3-5 and 10-13 illustrate the improvement of the present invention. Examples 6-9 are given for purposes of comparison and are representative of the standard SPB Process (i.e. the prior art) in which the fabrics obtained were composed of single component fibers having no useful crimp. The results obtained and conditions used in Example 2 are also given in Table I.

TABLE I

| Ex. | Fabric wt oz/yd$^2$ (g/m$^2$) | Fabric Thickness mils | Polymer[(1)] Component Ratio A:B | Filament Cross-Section | Modication Ratio | Filament dpf | Crimp Level Crimps per inch (m) $C_oC_E$ |
|---|---|---|---|---|---|---|---|
| 2 | 1.32 (51.6) | 14.0 | 50:50 | Round | — | 4.9 | 11.04(434.6)/-7.2(283.5) |
| 3 | 3.26 (110.6) | 21.6 | " | " | — | " | 11.04(434.6)/-7.2(283.5) |
| 4 | 1.55 (52.6) | 14.5 | 40:60 | " | — | 4.5 | 18.65(734.3)/-12.6(496.1) |
| 5 | 1.47 (49.9) | 13.7 | 60:40 | " | — | 4.1 | 6.82(268.5)-5.1(200.8) |
| 6 | 1.40 (47.5) | 13.8 | 0:100 | " | — | " | 4.12(162.2)-3.57(140.6) |
| 7 | 2.88 (97.7) | 20.2 | 0:100 | " | — | " | 4.12(162.2)-3.57(140.6) |
| 8 | 1.45 (49.2) | 14.0 | 100:0 | " | — | 4.4 | 4.22(166.1)/-3.6(141.7) |
| 9 | 3.48 (118.1) | 21.4 | 100:0 | " | — | " | 4.22(166.1)/-3.6(141.7) |
| 10 | 1.50 (50.9) | 14.8 | 60:40 | trilobal | 2.44 | 4.3 | 14.36(565.4)/-10.9(429.1) |
| 11 | 1.49 (50.6) | 15.8 | 0:100 | " | 2.10 | 3.6 | 4.63(182.3)/-3.0(118.1) |
| 12 | 1.41 (47.9) | 14.2 | 50:50 | " | 2.48 | 4.3 | 21.07(829.5)/-14.4(566.9) |
| 13 | 2.77 (94.0) | 20.5 | 50:50 | " | " | " | 21.07(829.5)/-14.4(566.9) |

[(1)]A:B is $CaF_2$-containing Component to Other Component

Filaments of the highest crimp level were obtained when the filaments were of a trilobal cross-section and the polymer component ratio (A:B) was 50:50. Fabrics prepared in accordance with the present invention had a soft hand, good flexibility and were well bonded, whereas in comparison the fabrics prepared by the standard SPB Process (Examples 6-9) had a harsh hand, were relatively inflexible, poorly bonded and, in general, lacked apparel qualities.

EXAMPLE 14

This example illustrates the effect of polymer ratio on crimp level of nylon 66 bicomponent filaments.

Filament samples were prepared and deposited onto a moving belt using the apparatus and technique described in Example 2 and the polymers described in Example 1. The filaments were of a round cross-section. The polymer ratio of the filaments was varied from sample to sample. The filaments were removed from the belt and the crimp level ($C_o$) was determined. The results obtained are given below in Table II.

TABLE II

| Sample | Polymer Ratio A:B | Crimp Level $C_o$ |
|---|---|---|
| 1 | 0:100 | 4.1 |

TABLE II-continued

| Sample | Polymer Ratio A:B | Crimp Level $C_o$ |
|---|---|---|
| 2 | 40:60 | 18.7 |
| 3 | 50:50 | 11.0 |
| 4 | 60:40 | 6.8 |
| 5 | 100:0 | 4.2 |

Although the invention has been illustrated with nylon 66 similar results will also be obtained with polyesters (e.g. PET) and other fiber-forming polymers. Also, if desired, a cross flow of cooling air may be used to further increase the crimp level of the side-by-side bicomponent filaments described therein and a and a filament separation step may be incorporated after the filaments are attenuated and before they are deposited on the belt. The use of a cross flow of cooling air and a filament separation step are usually desirable where a large number of filaments are being processed.

We claim:

1. A process for preparing a point-bonded, nonwoven fabric having apparel-like qualities comprising:

(1) melt spinning side-by-side bicomponent filaments in which both components are composed of the same polymer and one component contains at least 500 ppm of $CaF_2$ uniformly dispersed therein, with no $CaF_2$ in the other component, (2) quenching said filaments, (3) pneumatically attenuating said quenched filaments, (4) depositing said attenuated filaments onto a moving surface to form a web, (5) point-bonding said filaments to provide a nonwoven fabric, and (6) collecting said fabric wherein said steps (1) through (4) occur within a period of time less than 0.5 seconds and wherein the ratio of the two components and the amount of $CaF_2$ in said $CaF_2$-containing component are correlated to provide filaments which without being heated develope at least 5 crimps per inch of non-extended length after being attenuated and prior to being deposited onto said moving surface.

2. The process of claim 1 wherein said polymer is polyhexamethylene adipamide.

3. The process of claim 2 wherein the filaments are of a non-round cross-section.

4. The process of claim 3 wherein the filaments are of a trilobal cross-section.

5. The process of claim 2 wherein the quenching of the filaments is assisted by means of a cross flow of air.

6. The process of claim 2 wherein the ratio of the two components and the amount of $CaF_2$ in the $CaF_2$-containing component are correlated to provide filaments having a developed crimp level of at least 10 crimps per inch (393.7 crimps per meter) of non-extended filament length.

* * * * *